United States Patent [19]

Kumekawa et al.

[11] Patent Number: 4,561,274

[45] Date of Patent: Dec. 31, 1985

[54] METHOD OF AND APPARATUS FOR FORGING HOLLOW BLANK MEMBER

[75] Inventors: Kazuhisa Kumekawa, Tsurugashima; Shinichi Ando, Higashimatsuyama, both of Japan

[73] Assignee: Jidosha Kiki Co., Ltd., Tokyo, Japan

[21] Appl. No.: 670,178

[22] Filed: Nov. 9, 1984

[30] Foreign Application Priority Data

Nov. 16, 1983 [JP] Japan ..... 58-215524

[51] Int. Cl.[4] ..... B21D 19/00

[52] U.S. Cl. ..... 72/54; 72/370; 72/466

[58] Field of Search ..... 72/54, 58, 61, 62, 370, 72/466

[56] References Cited

U.S. PATENT DOCUMENTS 3,889,506 6/1975 Shaffer ..... 72/370
3,964,284 6/1976 Boultinghouse ..... 72/54
4,299,105 11/1981 Whitworth ..... 72/54

FOREIGN PATENT DOCUMENTS 55-22462 2/1980 Japan ..... 72/370
57-206546 12/1982 Japan .
58-93537 6/1983 Japan .

*Primary Examiner*—Leon Gilden
*Attorney, Agent, or Firm*—Flynn, Thiel, Boutell & Tanis

[57] ABSTRACT

A method of and an apparatus for shaping a hollow blank member by a forging operation is provided. The interior of a hollow blank member is filled with a liquid pressure medium which is enclosed therein in sealed condition. An external pressure is applied to the hollow blank member, and the pressure of the pressure medium is maintained as an internal pressure which opposes the external pressure, and part of the pressure medium is discharged externally while applying a desired plastic deformation to the hollow blank member.

7 Claims, 9 Drawing Figures

METHOD OF AND APPARATUS FOR FORGING HOLLOW BLANK MEMBER

BACKGROUND OF THE INVENTION

The invention relates to a method of and apparatus for forging a hollow blank member, and more particularly, to such method and apparatus which is preferred for use in the manufacture of a rack.

In the prior art, there are a number of techniques proposed which may be used to form a rack from a hollow rod in order to reduce the weight of the rack. A rack blank is formed from a hollow rod, and subsequently, a steel rod of a size which is commensurate with the internal diameter of the hollow section is fitted into a portion of the rack blank where rack teeth are to be shaped, as disclosed in Japanese Laid-Open Patent Applications No. 195,960/1982 and No. 206,546/1982. Alternatively, a material of indefinite configuration such as sand may fill the hollow interior of the rack blank, as disclosed in Japanese Laid-Open Patent Application No. 93,537/1983. The resulting rack blank is subsequently mounted in a recess of a lower die, and a punch is used to cause a plastic deformation of a region of the rack blank which is to be machined, thus forming rack teeth.

With these conventional techniques, if the steel rod is used to fill the interior of the rack blank, the steel rod must be left within the portion of the rack blank where the teeth are shaped after the completion of the rack teeth. Alternatively, if sand is employed, a stop member which is used to hold the quantity of sand within the hollow interior must be left within the shaped teeth portion of the rack blank. In either instance, the steel rod or the stop member which is left within the rack destroys the very purpose of reducing the weight of the rack.

A conventional apparatus for manufacturing a rack is illustrated in FIGS. 1(*a*) and (*b*). An arrangement shown in FIG. 1 (*a*) represents a forging apparatus of so-called closed type in which a rack blank 2 which is mounted in a recess within a lower die 1 is pressed by an upper die 3 which tightly fits in the recess, thereby forming rack teeth. This arrangement requires that the rack blank 2 be previously finished to a high accuracy since there is no place to relieve the metal of the rack blank 2 during its plastic deformation. An arrangement shown in FIG. 1 (*b*) illustrates a forging apparatus of so-called semi-closed type in which a rack blank 2' is mounted in a recess of a lower die 1', with the rack blank partly exposed out of the lower die 1'. An upper die 3' has a recess in its lower surface in which a tooth profile is defined, and is fitted over the exposed portion of the rack blank 2. When the die 3' is pressed against the latter, a clearance is left between the upper and lower dies 1', 3' to provide a space where the metal may be relieved during the plastic deformation, thus forming burrs 2'*a*. This arrangement eliminates the need for a high accuracy of previously machining the rack blank 2', but disadvantageously results in a degraded yield since a subsequent deburring operation is required (see FIG. 1(*c*)).

SUMMARY OF THE INVENTION

Therefore, it is an object of the invention to provide a method of and an apparatus for forging a hollow blank member which does not require a high accuracy in machining the blank member.

It is another object of the invention to provide a method of and an apparatus for forging a hollow blank member which eliminates the need for a subsequent deburring step.

It is a further object of the invention to provide a method of and an apparatus for forging a hollow blank member which permits a reduction in the weight of a resulting product.

Above objects of the invention are achieved by initially filling the interior of a hollow blank member with a liquid pressure medium and enclosing the medium sealed therein, applying an external pressure to the hollow blank member, maintaining the pressure of the liquid medium as an internal pressure which opposes the external pressure, and discharging part of the pressure medium externally while applying a desired plastic deformation to the hollow blank member.

Other objects, features and advantages of the invention will become apparent from the following description with reference to the attached drawings.

BRIEF DESCRIPTION OF THE DRAWINGS

FIG. 1(*c*) is a cross section of a rack formed by the apparatus of FIG. 1(*b*);

FIG. 2(*b*) is a cross section taken along the line B—B shown in FIG. 2(*a*);

FIG. 2(*c*) is a fragmentary view, to an enlarged scale, of the apparatus shown in FIG. 2(*a*);

DESCRIPTION OF EMBODIMENTS

Figure 1A:
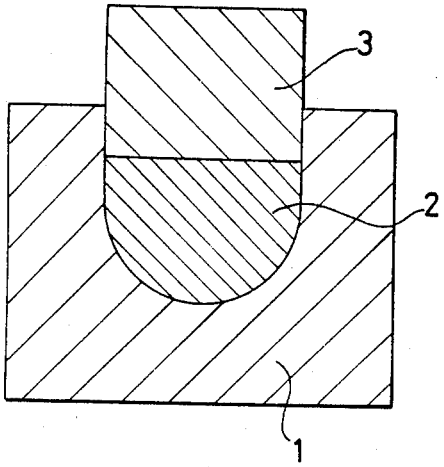
FIG. 1(a) PRIOR ART
FIGS. 1(*a*) and (*b*) schematically show part of conventional apparatus for forging a rack, FIG. 1(*a*) showing an apparatus of closed type and FIG. 1(*b*) showing an apparatus of semi-closed type, both in cross section.
Figure 1B:
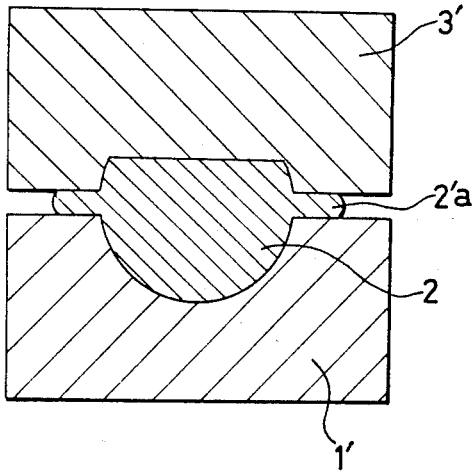
Figure 1C:
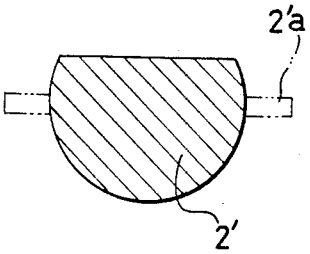
Figure 2A:
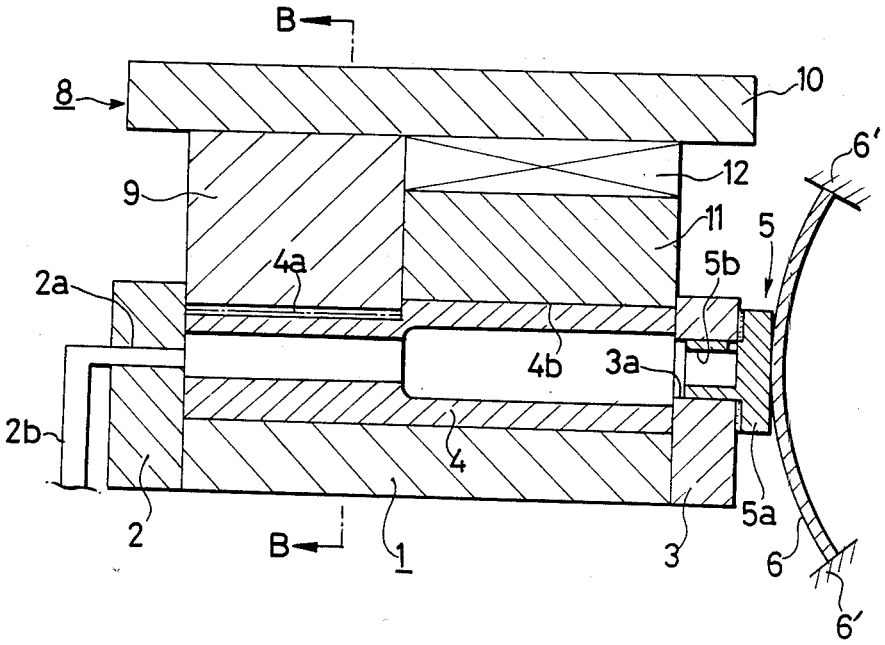
FIG. 2(*a*) is a longitudinal section of an apparatus according to one embodiment of the invention.
Figure 2B:
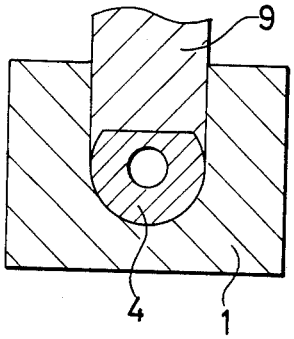
Figure 2C:
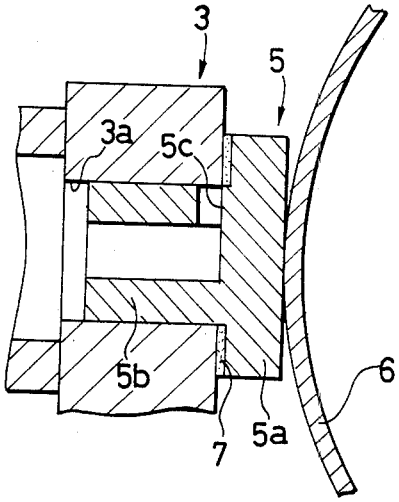

Referring to the drawings, several embodiments of the invention will be described. FIGS. 2(*a*), (*b*) and (*c*) show an apparatus according to one embodiment of the invention, FIG. 2(*a*) being a longitudinal section and FIG. 2(*b*) being a cross section taken along the line B—B shown in FIG. 2(*a*).

The apparatus includes a lower die 1 and a pair of side dies 2, 3 which are held tightly against the opposite longitudinal end faces of the lower die, thus forming a recess in which a rack blank 4 is to be received. The both side dies 2, 3 are formed with a small hole 2*a* and an opening 3*a*, respectively, both of which extend horizontally. The hole 2*a* is connected to a conduit 2*b* for a pressure medium while a pressure withstanding valve 5 is slidably and tightly fitted into the opening 3*a*. A leaf spring 6 bears against the outer side of the valve 5, thus resiliently supporting it against sliding arrangement until an internal pressure in excess of a given value acts upon the valve 5.

FIG. 2(*c*) shows the relative disposition of the side die 3, the valve 5 and the leaf spring 6. Specifically, the valve 5 includes a flange 5*a* which is tightly held against the side die 3, with a sealing member 7 interposed therebetween to maintain a hermetic seal. The valve 5 which is fitted into the opening 3*a*, formed in the side die 3, is formed with a cylindrical portion 5*b* which is provided with a small slot 5*c* toward its end located adjacent to the flange 5*a*, the arrangement being such that a communication between the interior and the exterior of the valve 5 is established as a result of a sliding movement of the valve 5 to the right when an internal pressure in excess of a given value acts upon the valve 5. Consequently, when a liquid pressure medium is injected through the conduit 2*b*, the medium can fill the hollow interior of the rack blank member 4 which is mounted in the lower die 1. While not shown, it is to be understood that the conduit 2*b* is associated with a provision which interrupts the pressure medium. In FIG. 2(*a*), the leaf spring 6 is shown as anchored across a pair of support members 6'.

A member which provides an upper die is disposed above the lower die 1. The upper die 8 comprises a punch 9 having a lower surface in which a tooth profile for forming rack teeth is defined, and a holder 10 which fixedly carries the punch 9. The lower surface of the holder 10 carries a retainer 11 with a spring 12 interposed therebetween. The retainer 11 is disposed in juxtaposition with the punch 9 and is slidable relative to the latter. Accordingly, when the upper die 8 is depressed to perform a press operation of a region 4*a* of the rack blank member 4 which is to be machined, the retainer 11 resiliently bears against a non-machined portion 4*b* of the blank member 4, thus securing it in position.

Figure 3:
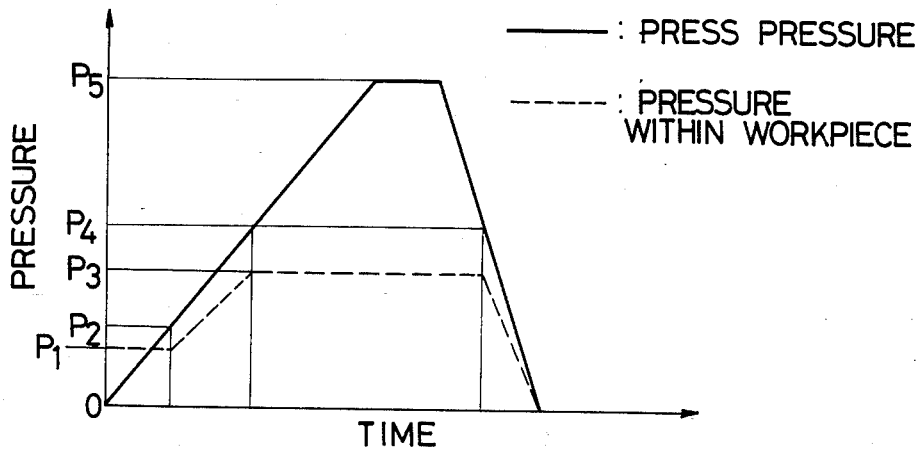
FIG. 3 graphically shows the press pressure and the internal pressure of the pressure medium during the process of manufacturing a rack with the apparatus of the invention, illustrating their rising patterns.

A process of manufacturing a rack will now be described with reference to FIGS. 2 and 3. The rack blank member 4 of a given size formed by a hollow member is fitted into a space which is defined by the lower die 1 and the both side dies 2, 3, and the valve 5 is fitted into the side die 3. The valve 5 is fitted to a degree such that the slot 5*c* formed in the valve 5 is exposed to the atmosphere. Oil, serving as a liquid pressure medium, is injected into the hollow interior of the rack blank member 4 through the conduit 2*b*, and the internal air is displaced through the slot 5*c*. After confirming that the interior is fully filled with the oil, the valve 5 is further tightly fitted into the side die 3, and the leaf spring 6 is disposed in abutting relationship with the valve 5. Subsequently, the upper die 8 is lowered to begin the shaping operation of the portion 4*a* of the rack blank member 4. As shown graphically in FIG. 3, the oil pressure in the hollow interior assumes a value $P_1$ (kg/cm$^2$) as it is injected. When the press pressure increases gradually, the oil pressure within the hollow interior rises when the former exceeds a value $P_2$ (kg/cm$^2$), initiating a plastic deformation of the blank portion 4*a*. The oil pressure reaches a value $P_3$ (kg/cm$^2$) when the press pressure increases to a value $P_4$ (kg/cm$^2$). The internal pressure having a value $P_3$ (kg/cm$^2$) causes the valve 5 to slide toward the exterior against the resilience of the leaf spring 6, thus exposing the slot 5*c* formed therein and allowing the oil to be discharged therethrough. It is to be noted that the amount of such oil discharge is equal to the volume by which the punch 9 has advanced into the rack blank member 4, thus maintaining the oil pressure at the constant value of $P_3$ (kg/cm$^2$) independently from an increase in the press pressure. The press pressure no longer increases if the punch 9 has reached its maximum stroke, and this final pressure $P_5$ (kg/cm$^2$) is effective to shape the rack teeth. Subsequently, the upper die 8 is raised, thereby completing the operation.

It will be appreciated from the foregoing description that the apparatus of the invention, while it performs a closed forging operation, permits rack teeth to be shaped to a high accuracy using a rack blank member 4 which need not be machined to any significant accuracy. In addition, the formation of burrs is avoided by employing a hollow member which is internally filled with oil so that when the oil pressure exceeds a given value during the forging operation of the rack teeth, the oil is discharged in an amount corresponding to the magnitude of deformation of the blank member. Accordingly, the subsequent deburring step as required in the conventional process is avoided, and the overall effect is the provision of forging means which facilitates a shaping operation.

Figure 4:
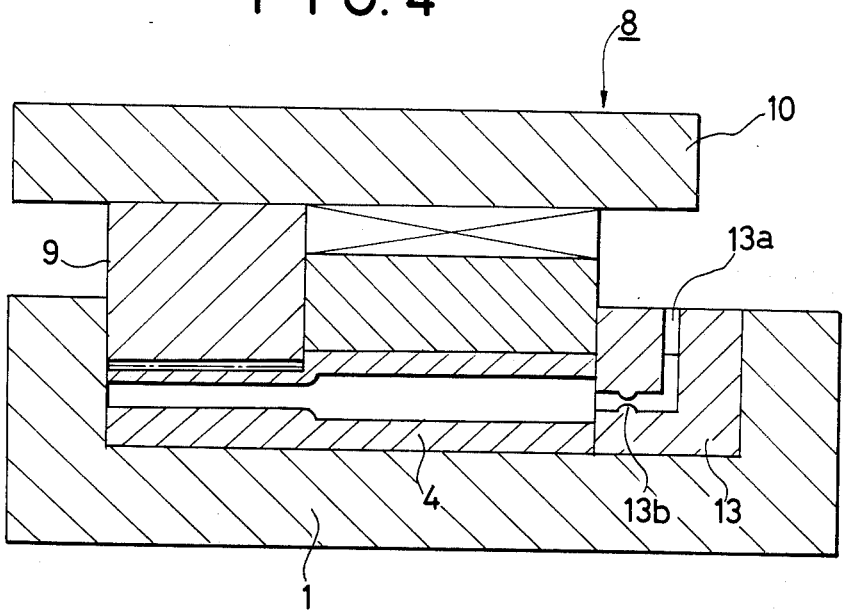
FIG. 4 is a longitudinal section of an apparatus according to another embodiment of the invention.
Figure 5:
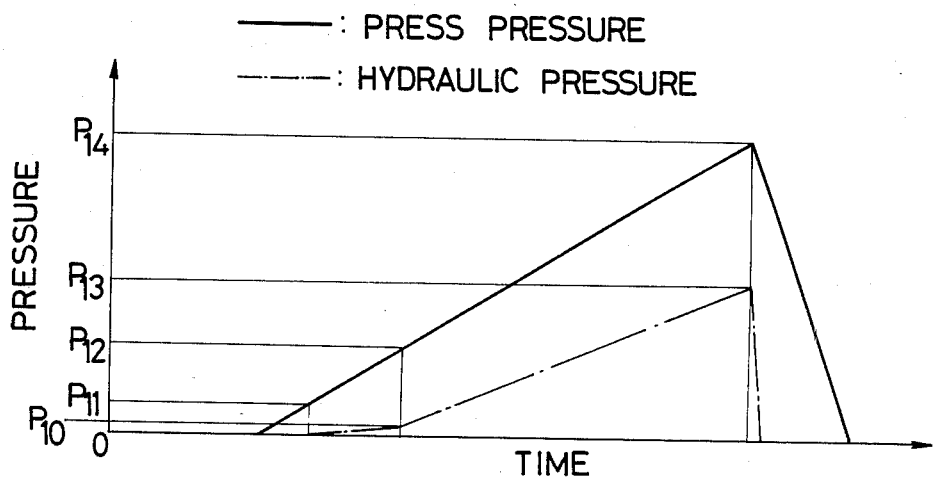
FIG. 5 graphically shows pressure patterns similar to those shown in FIG. 3, obtained for the arrangement of FIG. 4.

FIGS. 4 and 5 illustrate another embodiment of the invention. The apparatus of this embodiment is generally similar to the arrangement of the previous embodiment except for a portion thereof which is equivalent in function to the valve 5 of the previous embodiment. Specifically, a side die member 13 having an elongate passage 13*a* of folded configuration is fitted into part of the lower die 1. An orifice 13*b* is defined in a portion of the passage 13*a* to provide a restricting effect. Accordingly, when oil, serving as pressure medium, is injected into the hollow interior of a main rack blank member 4 which is fitted into the lower die 1, the amount of injection can be adjusted so that the oil level lies above the location of the orifice 13*b*.

When the punch 9 is lowered to press against the portion 4*a* of the rack blank member 4, the press pressure and the oil pressure increase as shown graphically in FIG. 5. It will be noted from FIG. 5 that the oil pressure begins to increase gradually when the press pressure reaches a value $P_{11}$ (kg/cm$^2$), beginning the discharge of the oil through the passage 13*a*. When the press pressure exceeds a value $P_{12}$ (kg/cm$^3$), the restriction provided by the orifice 13*b* comes into play, and the oil pressure rises sharply as the punch 9 is lowered, causing a plastic deformation in the portion 4*a* of the rack blank member 4, thus shaping the rack teeth. When the punch 9 reaches its maximum stroke at the press pressure of $P_{14}$ (kg/cm$^2$) and the oil pressure of $P_{13}$ (kg/cm$^2$) the shaping operation for the rack teeth is completed. Subsequently, the punch 9 may be raised to complete the operation. It is to be noted that the restriction provided by the orifice 13*b* may not be effective and a desired plastic deformation may not occur if the maximum flow rate of the oil through the orifice 13*b* is less than the rate of change of the volume produced by the stroking of the punch 9.

It will be appreciated that the pressure pattern for the pressure can be suitably chosen depending on the variety of racks. Also it will be understood that the valve 5 need not be provided with a small slot as shown, but may have any construction which permits the liquid pressure medium to be discharged when it is subjected to the internal pressure of a given value. Also the leaf spring 6 which resiliently biases the valve 5 may be replaced by any other suitable bias means.

While the invention has been described above in connection with the manufacture of a rack, it should be understood that the method and the apparatus of the invention are equally applicable to other elements other than the rack such as a spur gear, provided it includes a central space.

While the invention has been shown and described above with reference to several embodiments thereof, it should be understood that a number of changes, modifications and substitutions will readily occur to one skilled in the art without departing from the scope and spirit of the invention, and therefore that the invention is solely defined by the appended claims.

What is claimed is:

1. A method for forging a hollow blank member comprising the steps of filling the hollow interior of a hollow blank member with a liquid pressure medium and enclosing the latter in sealed condition therein, applying an external pressure to the hollow blank member when the latter is filled with the pressure medium, allowing part of the pressure medium to be discharged gradually so as to maintain the pressure of the pressure medium as an internal pressure which opposes the external pressure, and applying a desired plastic deformation to the hollow blank member while the pressure medium is being discharged.

2. An apparatus for forging a hollow blank member comprising a lower die having a recess formed therein which receives a hollow blank member so as to block its opening, an upper die adapted to be fitted into the recess, the lower die being formed with a passage which allows the internal space of the hollow blank member which is received within the lower die to communicate with the exterior, and means disposed within the passage for restricting the flow rate of the pressure medium enclosed within the hollow blank member and discharged as a result of the application of the external pressure by the upper die, whereby said means maintains an internal pressure.

3. An apparatus for forging a hollow blank member according to claim 2 in which said means for restricting the flow rate comprises a valve which closes the passage, and a bias spring for normally urging the valve in a direction to block the passage and for restricting a clearance formed between the valve and the passage for discharge of the pressure medium when the external pressure is applied.

4. An apparatus for forging a hollow blank member according to claim 3 in which said bias spring comprises a leaf spring having a curved surface, with the convex surface of the leaf spring resiliently abutting against the valve.

5. An apparatus for forging a hollow blank member according to claim 3 in which the valve has a cylindrical portion which is fitted into the passage and which is formed with a slot which permits a communication to be established between the interior of the hollow blank member and the exterior.

6. An apparatus for forging a hollow blank member according to claim 2 in which said means for restricting the flow rate comprises an orifice formed in the passage for restricting the flow rate of the pressure medium as it is discharged when the external pressure is applied.

7. An apparatus for forging a hollow blank member according to claim 2 in which the upper die includes a retainer which retains in position a portion of the hollow blank member which is not subject to a shaping operation.

* * * * *